US007090892B2

(12) United States Patent
Becker et al.

(10) Patent No.: US 7,090,892 B2
(45) Date of Patent: Aug. 15, 2006

(54) METHOD AND APPARATUS FOR THE REMOVAL OF EXCESS COATING MATERIAL FROM A HONEYCOMB BODY

(75) Inventors: Robert Becker, Wayne, PA (US); Rolf Bruck, Bergisch Gladbach (DE)

(73) Assignee: Advanced Technology Products, Inc., Wayne, PA (US)

( * ) Notice: Subject to any disclaimer, the term of this patent is extended or adjusted under 35 U.S.C. 154(b) by 0 days.

(21) Appl. No.: 10/964,419

(22) Filed: Oct. 13, 2004

(65) Prior Publication Data

US 2005/0048203 A1 Mar. 3, 2005

Related U.S. Application Data

(62) Division of application No. 10/238,429, filed on Sep. 9, 2002.

(51) Int. Cl.
*B05D 3/12* (2006.01)
*B05D 7/22* (2006.01)

(52) U.S. Cl. ..... 427/232; 427/231; 427/235; 427/240; 427/346; 427/348; 118/52; 118/55; 118/56; 118/57

(58) Field of Classification Search ..... 427/240, 427/425, 346, 348, 231, 232, 235; 118/52, 118/320, 55, 56, 57
See application file for complete search history.

(56) References Cited

U.S. PATENT DOCUMENTS

| | | | | |
|---|---|---|---|---|
| 648,601 | A | 5/1900 | Stridsberg | |
| 2,009,232 | A | 7/1935 | Hood | |
| 2,369,155 | A | 2/1945 | Marinsky et al. | |
| 3,503,157 | A | 3/1970 | Harper | |
| 3,537,424 | A | 11/1970 | Sadler | |
| 3,873,350 | A | 3/1975 | Dwyer et al. | |
| 4,191,126 | A | 3/1980 | Reed et al. | |
| 4,208,454 | A | 6/1980 | Reed et al. | |
| 4,586,292 | A | 5/1986 | Carroll et al. | |
| 5,077,093 | A | 12/1991 | Baumgartner et al. | |
| 5,798,140 | A * | 8/1998 | Parodi et al. | 427/240 |
| 6,361,486 | B1 | 3/2002 | Gordon | |
| 2003/0224105 | A1 * | 12/2003 | Chondroudis et al. | 427/240 |

FOREIGN PATENT DOCUMENTS

| | | |
|---|---|---|
| EP | 1308256 A | 5/2003 |

OTHER PUBLICATIONS

International Search Report mailed on Aug. 2, 2004 in PCT/US2004/005536.
Written Opinion of the International Searching Authority mailed on August 2, 2004 in PCT/US2004/005536.

* cited by examiner

*Primary Examiner*—Kirsten Jolley
(74) *Attorney, Agent, or Firm*—Smith Moore LLP

(57) ABSTRACT

A method and apparatus for removing excess coating material from a honeycomb body of a catalytic converter. The coated honeycomb body is mounted on an eccentric tappet and is rotated around a first rotational axis with a first rotational frequency such that the distance from the center of gravity of the honeycomb body to the first rotational axis is at least 1.5 times the length of the honeycomb body. The honeycomb body is further rotated around a second rotational axis even out the coating material and provide a more uniform coating surface.

20 Claims, 2 Drawing Sheets

METHOD AND APPARATUS FOR THE REMOVAL OF EXCESS COATING MATERIAL FROM A HONEYCOMB BODY

This application is a division of utility patent application Ser. No. 10/238,429, filed Sep. 9, 2002 and now pending.

BACKGROUND OF THE INVENTION

The present invention relates to catalytic converters, and more particularly, to a method and apparatus for the removal of excess coating material from a catalytic converter honeycomb body which is capable of having fluid flow through it and which exhibits flow channels. The general flow direction of the flow channels is defined by the longitudinal axis of the honeycomb body and the honeycomb body has an axial length and a center of gravity. The honeycomb body is surface coated and is then rotated around a first rotational axis with a first rotational frequency in the direction of the longitudinal axis. The distance between the center of gravity of the honeycomb body and the rotational axis is at least 1.5 times the axial length of the honeycomb body.

A catalytic converter support body generally includes a honeycomb body having a large enough surface to exchange exhaust fumes flowing through the support body with high efficiency. As shown in FIG. 1, a honeycomb body 2 includes a plurality of flow channels 17 formed of wrapped or layered metal foils 4 that are located between bordering layers 3. The flow channels 17 define the longitudinal axis of the honeycomb body 5. The honeycomb body 2 is preferably made from rust resistant and high temperature resistant steel.

Even though the flow channels 17 of the honeycomb body 2 preferably have a large enough surface area to exchange harmful fumes, it is known in the art to coat the flow channels 17 of the honeycomb body 2 with a coating material 1. Such coating materials may include gamma-aluminum oxide or washcoat made from oxides. These coatings are catalytically active or are necessary coating materials for machines. Specifically, the coating material lifts catalysts such as platinum or rhodium, and thereby causes a further mixing of the exhaust fumes which flow through the honeycomb body 2 because of the extremely intensive contact of the catalysts with the exhaust fumes. Normally, the honeycomb body 2 is submerged into a bath of emulsified coating material or sprayed with such material so that the complete surface of the honeycomb body is coated. Afterwards, the excess coating material is removed from the surface by means of compressed air, especially from the flow channels 17. This procedure for removing the excess coating material is suitable if the flow channel 17 cross section is large enough and if the coating thickness is relatively thick because in such a case, the surface tension of the capillary force is of no significance.

However, in order to enlarge the surface of the catalyst to increase catalytic conversion efficiency, it is necessary to further increase the density of the flow channels 17. Until recently, cell densities of less than 600 cpsi (cells per square inch) were usual, but the goal now is to reach a cell density of 1000 or more cpsi. With higher cell densities, smaller flow channel 17 cross-sections exist, so the influence of the surface tension and the capillary power increases. This causes drops of the coating material 1 to fall into the flow channels 17, which leads to a coating surface having varied thickness 19 and sometimes clogs and damages the flow channel 17, as shown in FIG. 2. Thus, the varying thickness D of the coating is a significant problem associated with increasing cell densities in honeycomb bodies 2.

Accordingly, there is a need in the art for a method of removing excess coating material from honeycomb bodies having increased cell densities and small flow channels to provide a uniform application of the coating material. There is a further need for an apparatus suitable for performing such a procedure.

SUMMARY OF THE INVENTION

The method of removing excess coating material from a honeycomb body of the present invention comprises the steps of coating the honeycomb body with a coating material, defining a longitudinal axis of the honeycomb body, and rotating the honeycomb body around a first rotational axis with a first rotational frequency to create a centrifugal acceleration. The rotating step comprises the step of rotating the honeycomb body around the first rotational axis with the first rotational frequency in at least a partial direction of the longitudinal axis of the honeycomb body to create the centrifugal acceleration. Preferably, the distance between the center of gravity of the honeycomb body and the first rotational axis is at least 1.5 times, more preferably five times, and most preferably ten times longer than the length of the honeycomb body.

In a preferred embodiment, an additional acceleration is added to the centrifugal acceleration. The additional acceleration may be generated by changing the frequency of the first rotational frequency or by rotating the honeycomb body around a second rotational axis with a second rotational frequency, wherein the first rotational axis is different from the second rotational axis. Preferably, the first rotational frequency is faster than the second rotational frequency such that the ratio of the first rotational frequency to the second rotational frequency is at least 5:1, more preferably 20:1, and most preferably 100:1. Also, the total acceleration resulting from a sum of the centrifugal acceleration and the additional acceleration is at least two times higher, more preferably six times higher, and most preferably twenty times higher than an acceleration of gravity.

The method may further include the steps of subjecting the honeycomb body to an additional compressed air current before or after creating the centrifugal acceleration. Also, the honeycomb body may be subjected to vibration during the rotating step.

An apparatus for removing excess coating material from a honeycomb body is also provided. The apparatus comprises an eccentric tappet that is capable of holding at least one honeycomb body. The eccentric tappet rotates the honeycomb body around the first rotational axis with the first rotational frequency to create the centrifugal acceleration. A first motor provides the power for the tappet to rotate around the first rotational axis. The first motor changes the frequency of the first rotational frequency to obtain a first additional acceleration. The eccentric tappet also rotates the honeycomb body around the second rotational axis with the second rotational frequency to obtain a second additional acceleration.

BRIEF DESCRIPTION OF THE DRAWINGS

The present invention is better understood by a reading of the Detailed Description of the Preferred Embodiments along with a review of the drawings, in which.

DETAILED DESCRIPTION OF THE PREFERRED EMBODIMENTS

The illustrations and examples discussed in the following description are provided for the purpose of describing the preferred embodiments of the invention and are not intended to limit the invention thereto.

Figure 1:
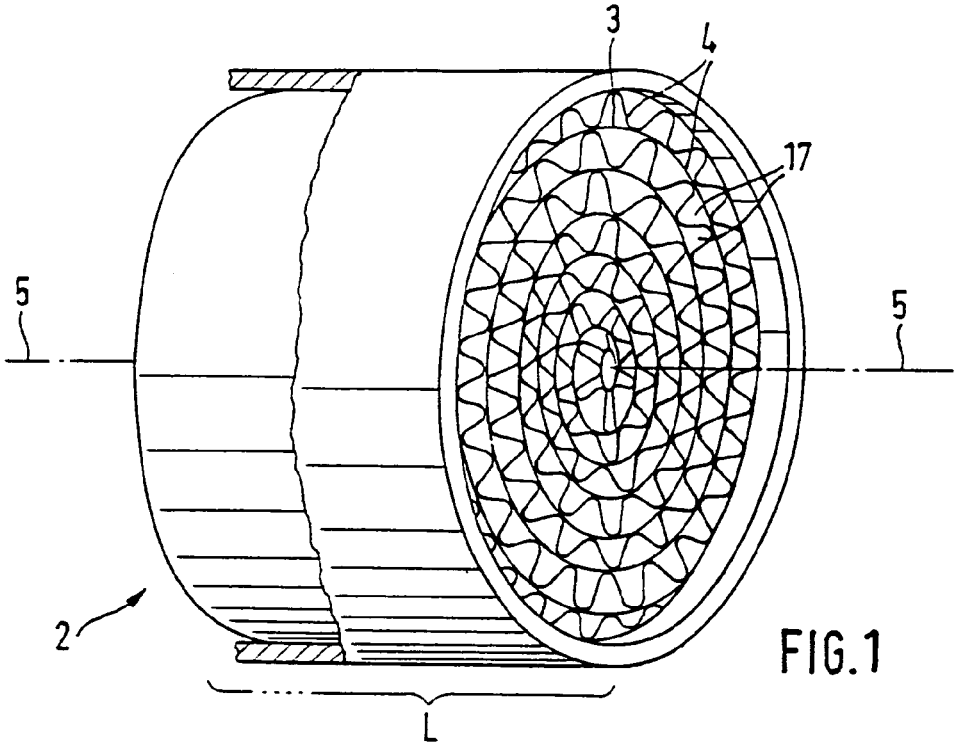
FIG. 1 is a perspective view of a honeycomb body to be coated.
Figure 2:
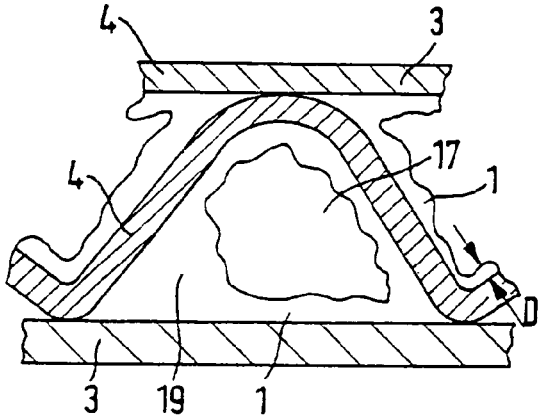
FIG. 2 is a cross sectional view of a flow channel in the honeycomb body of FIG. 1.

The method for removing excess coating material from a honeycomb body of the present invention provides a uniform coating surface on the honeycomb body. This is particularly important with honeycomb bodies 2 having a high cell density or small flow channel cross-sections, such as metallic honeycomb bodies 2 that are partially structured as wrapped or layered sheet metal 4, as shown in FIGS. 1 and 2. The wedge-shaped triangular areas of the flow channels 17, occurring especially in metallic honeycomb bodies 2, impede the flow of exhaust fumes through the support body 2 and contribute less to the catalytic conversion but normally absorb a high amount of the expensive coating material.

Figure 3:
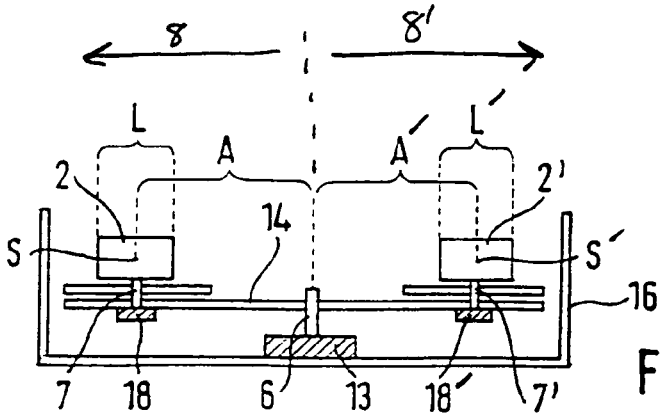
FIG. 3 is a cross sectional view of the apparatus of the present invention removing excess coating material from a honeycomb body.

In order to remove the excess coating material from the flow channels 17, the honeycomb body 2 is rotated about a first rotational axis 6 with high eccentricity by an apparatus for removing excess coating material in accordance with the present invention. As shown in FIG. 3, the apparatus includes an eccentric tappet 14 capable of holding at least one honeycomb body 2. While the Figures and this discussion sometimes refers to the tappet 14 as holding two honeycomb bodies 2,2', it should be understood that the present invention is not limited thereto. The eccentric tappet 14 may include only one honeycomb body 2. The tappet 14 rotates the honeycomb bodies 2,2' around a first rotational axis 6 with a first rotational frequency by means of a first motor 13 connected to the tappet 14. This rotation releases centrifugal forces 8 pointing radially from the first rotational axis 6 to the outside. The centrifugal acceleration 8 effectively removes excess coating material from the honeycomb bodies 2,2' to achieve a uniform coating surface of the honeycomb bodies 2,2'.

The honeycomb bodies 2, 2' have an axial length L and a center of gravity S. Preferably, the distance A from center of gravity S of the honeycomb bodies 2, 2' to the first rotational axis 6 is at least 1.5 times longer, preferably five times longer, and most preferably 10 times longer than the axial length L of the honeycomb bodies 2,2'. The minimum distance A from the center of gravity S of the honeycomb bodies 2,2' to the first rotational axis 6 provides consistent amounts of the centrifugal acceleration 8 onto the coating material at different sections within the honeycomb bodies 2,2', thus providing a uniform coating surface. If the distance A from the center of gravity S of the honeycomb body 2 to the first rotational axis 6 is five times the length L of the honeycomb body 2, the relation of the centrifugal acceleration 8 at two spatial points within a (symmetrical) honeycomb body 2 is not higher than about 20%. Analogously, the difference between the centrifugal acceleration 8 at a point in the honeycomb body 2 closest to the first rotational axis 6 and the centrifugal acceleration 8 at a point in the honeycomb body 2 located furthest from the first rotational axis 6 is about 10%. This is also the case if the distance A from the center of gravity S of the honeycomb body 2 is ten times longer than the length L of the honeycomb body 2. In other words, the greater the distance A from the honeycomb body 2 to the first rotational axis 6, the more regular the effect of the centrifugal acceleration 8 is at different locations within the honeycomb body 2. The smaller the difference of the centrifugal acceleration 8 at different locations within the honeycomb body 2, the more uniformly the layer of the remaining coating material is.

Figure 4:
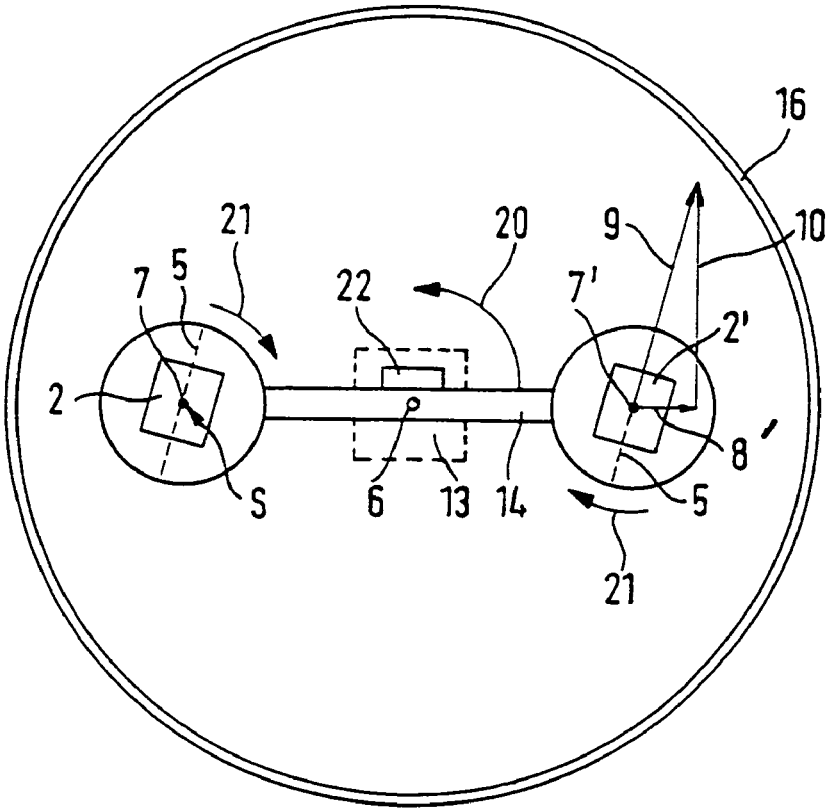
FIG. 4 is a top view of the apparatus of FIG. 3 in accordance with an embodiment of the present invention.

In a preferred embodiment of the present invention, the centrifugal acceleration 8 is overlaid with an additional acceleration 9 to achieve further uniformity of the coating surface and increase the driving force of the centrifugal acceleration 8, as shown in FIG. 4. This additional acceleration 9 can occur by either changing the rotational frequency of the first rotational axis 6 or rotating the honeycomb bodies 2,2' around a second rotational axis 7,7' that is different from the first rotational axis 6. The additional acceleration 9 makes it possible to obtain a more uniform coating because even more of the excess coating material, which causes the coating layer to have a varying thickness, can be removed.

According to one embodiment, the additional acceleration 9 is added by changing the rotational frequency around the first rotational axis 6. This change in the first rotational frequency causes an additional translateral acceleration force because the additional acceleration 9 runs tangential to circles around the first rotational axis 6 and the vector speed of the honeycomb body mainly changes its amount and not its direction. The change of the first rotational frequency can occur either from accelerating or braking the rotary motion with the motor 13 that is attached to the eccentric tappet 14. Preferably, the motor 13 changes the rotational frequency around the first rotational axis 6 based on timed, predetermined values. For example, it is preferred that the honeycomb body 2 reach the maximum rotational frequency after a predetermined run and, after a similar run, that the rotational frequency be braked, or more advantageously, abruptly stopped. In this case, the additional acceleration 9 can be extremely higher than the centrifugal acceleration 8. The amount of eccentricity of the predetermined frequency changes that is best suited to provide a uniform coating of the honeycomb body 2 is based on the distance A between the center of gravity S of the honeycomb body 2 and the first rotational axis 6. Preferably, the distance from the center of gravity S of the honeycomb body 2 to the first rotational axis 6 is at least 1.5 times, more preferably five times, and most preferably ten times the length of the honeycomb body. The minimum distance keeps the different acceleration forces at different points in the honeycomb body 2 sufficiently small. This is especially important if metallic honeycomb bodies with a high cell density have to be uniformly coated.

According to another embodiment of the present invention, the additional acceleration 9 occurs by rotating the honeycomb body 2,2' with a second rotational frequency around a second rotational axis 7,7' that is different from the first rotational axis 6. The second rotational axis 7,7' is either parallel to the first rotational axis 6 (without being identical), cuts the first rotational axis 6, or is askew to the first rotational axis 6. As shown in FIG. 4, the honeycomb bodies 2,2' rotate around the second rotational axes 7,7', respectively, on the eccentric tappet 14. The eccentric tappet 14 rotates around the first rotational axis 6 by means of the first motor 13 and the honeycomb bodies 2,2' rotate around the second rotational axes 7,7' by means of additional motors 18,18' or gear mechanisms. The motors 18,18' predetermine the rotational direction around the second rotational axes 7,7' respectively. Choosing the right rotational frequency around the particular axis 7 as well as the rotational direction provides an especially uniform coating of the honeycomb body 2 with coating material.

The centrifugal acceleration 8 occurs by rotating the honeycomb bodies 2,2' around the first rotational axis 6 and transporting the excess coating material in the honeycomb bodies 2,2' radially to the outside. Thus, the driving force for the removal of excess coating material is based on the centrifugal acceleration 8 around the first rotational axis 6. The rotation of the honeycomb bodies 2,2' around the respective second rotational axis 7,7' evens out the thickness of the coating layer to obtain a more uniform coating. This evening occurs because the areas of the honeycomb bodies 2,2' are located closer to the first rotational axis 6 and are transported, by means of the rotation around the respective second rotational axis 7,7' to the outside where they experience a sufficiently higher centrifugal acceleration.

In regard to time, the centrifugal acceleration 8 is generally constant for all areas in the honeycomb body 2 if the rotational frequency around the second rotational axis 7 is significantly smaller than the rotational frequency around the first rotational axis 6. Preferably the ratio of the first rotational frequency to the second rotational frequency is at least 5:1, more preferably 20:1, and most preferably 100:1. The increasing centrifugal acceleration 8, which occurs by rotating the honeycomb body 2 around the first rotational axis 6 and increases as the distance between the honeycomb body 2 and the first rotational axis 6 increases, is overlaid with the additional centrifugal acceleration 9, which occurs by rotating the honeycomb body 2 around the second rotational axis 7 and increases as the distance between the honeycomb body 2 and the second rotational axis 7 increases. The non-homogeneity of the accelerations is balanced throughout the honeycomb body 2 because the extensive distance A from center of gravity S of the honeycomb body 2 to the first rotational axis 6 (at least 1.5 times the length L of the honeycomb body) restricts differences in the centrifugal acceleration 8 at different points in the honeycomb body 2. Therefore, the combination of the centrifugal acceleration 8 and the additional acceleration 9, as well as a timely averaging, leads to a uniform centrifugal acceleration at all points in the honeycomb body 2 and a uniform removal of excess coating material. The result is uniform coating surface throughout the honeycomb body 2.

The tappet 14 may include a housing for collecting the excess coating material that is removed from the honeycomb body 2. Thus, excess coating material may be collected in a container 16 for recycling purposes.

A sufficient and timely addition of centrifugal acceleration 8 and additional acceleration 9, as described above, basically evens out the coating to provide a uniform coating surface. The additional acceleration 9 may change over time. For example, the additional acceleration 9 may, within certain time intervals, have its amount or direction changed. Particularly, after a honeycomb body 2 has been centrifuged around the first rotational axis 6, it may be turned 180° and then centrifuged around the second rotational axis 7,7'. It is particularly advantageous to adjust the honeycomb body 2 with its longitudinal axis 5 parallel to the resulting total acceleration 10. The total acceleration results from the sum of the centrifugal acceleration 8 due to the movement around the first rotational axis 6 and the additional acceleration 9. The excess coating material is then able to exit the flow channels 17 unimpeded due to the parallel alignment of the honeycomb body 2 to the resulting total acceleration 10. This provides a more uniform coating of the honeycomb body.

In a preferred embodiment of the present invention, there are two ways of obtaining the additional acceleration 9 by rotating the honeycomb body 2 around the second rotational axis 7, as discussed above. In the first variation, the rotational frequencies around both axes 6,7 are determined differently. As shown in FIG. 4, the rotation 20 of the eccentric tappet 14 around the first rotational axis 6 is opposite the rotation 21 around the second rotational axes 7,7'. Specifically, the honeycomb bodies 2,2' are rotated clockwise around the first rotational axis 6 with motor 13 and the honeycomb bodies 2,2' are rotated counter-clockwise around their respective second rotational axis 7,7' by means of their respective additional motor 18,18'. If the rotational frequency around the first rotational axis 6 is stopped abruptly, a total acceleration 10 results because of the superimposition of the centrifugal acceleration 8 and the additional acceleration 9, which is caused by the change of the rotational frequency around the first rotational axis 6. The honeycomb body 2 is adjusted in such a way that the honeycomb body 2 with its longitudinal axis 5, i.e., with its flow channels 17, points in the direction of the total acceleration 10, so that the excess coating material along the flow channels 17 is hurled out. The removed coating material 1 is transported to the container 16. By adjusting the two honeycomb bodies 2, 2' onto an eccentric tappet 14, the centrifugal acceleration 8 or the total acceleration 10 of the significant honeycomb body 2,2' of the other honeycomb body 2,2' is therefore balanced. The driving force for the removal of the coating material is mainly the translateral additional acceleration due to the change of the rotational frequency of the first rotational axis 6. The counter-clockwise rotation around the second rotational axis 7,7' serves to even out the coating thickness, effectively causing everywhere within the honeycomb body 2, 2' the same centrifugal force 8 due to the linearity between centrifugal force 8 and radius at a constant rotational frequency. A uniform coating surface is therefore achieved.

Figure 5:
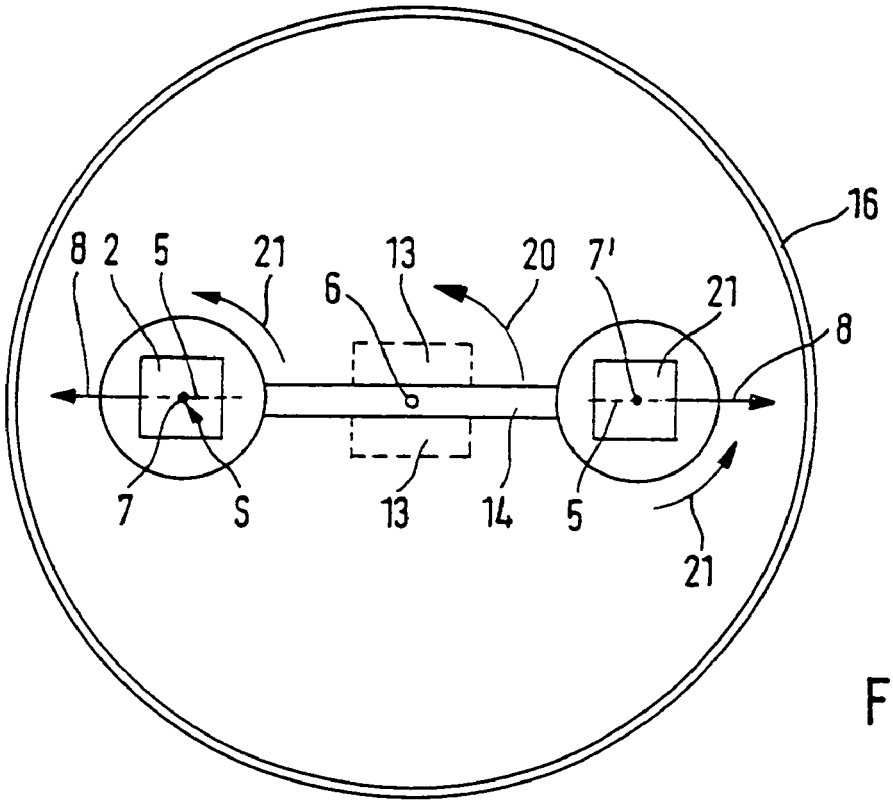
FIG. 5 is a top view of the apparatus of FIG. 3 in accordance with another embodiment of the present invention.

In the second variation, the rotational frequencies around both axes 6,7 are determined equally. The longitudinal axis of the honeycomb body 2 always points in the same spatial direction if both rotations show a counter clockwise rotation sense. The honeycomb body 2 moves in a circular course but the driving force for the removal of the excess coating material moves in a back-and-forth-movement. As shown in FIG. 5, the rotational frequency around the first rotational axis 6 is substantially higher than the rotational frequency around the second rotational axis 7,7'. In this case, there is no significance of the rotation 21 around the second rotational axis 7,7' with regards to the rotation 20 around the first rotational axis 6. Higher acceleration forces are in effect time-wise at points located farther from the second rotational axis 7 than at points closer to the second rotational axis 7, if both rotations have the same rotational direction. Therefore, different points in the honeycomb body 2 experience higher, but also different, acceleration forces. This means that the difference of the coating thickness between a place inside the honeycomb body 2 and one at its edge has the tendency to be higher with a rotation in the same rotational direction than with a different rotational direction. An identical rotation around both rotational axes 6,7 further evens out the coating to obtain a more uniform coating surface.

The sum of the effective total acceleration 10 resulting from the sum of the centrifugal acceleration 8 and the additional acceleration 9 is preferably at least twice, more preferably at least six times, and most preferably at least twenty times higher than the acceleration due to gravity to improve the effectiveness of the attacking acceleration forces. Such an additional acceleration 9 results in an especially fast and effective removal of excess coating material. This also provides for a thin coating surface.

The honeycomb body 2 further goes through an additional compressed air current in axial directions before or during the effect of the centrifugal acceleration 8, therefore supporting the removal of excess coating material.

A vibration generator 22 is provided to vibrate the honeycomb body 2 during centrifugation to prevent the setting of the coating material. The vibration keeps the coating material viscous so that the coating material cannot set. The result is a very thin coating of the honeycomb body 2. The vibration generator is preferably an ultrasound transducer sending sound-waves Obei frequencies between 20 kHz to 1 MHz preferably at frequencies between 50 kHz and 100 kHz.

The honeycomb body is put in and removed close to the first rotational axis 6 to avoid contact with excess coating material during the continuous production process. This allows a continuous and easy supply of the honeycomb bodies 2, 2' to the centrifuge, a removal of excess coating material, and the easy removal of honeycomb bodies 2,2' from the centrifuge.

The inventive method and apparatus described above for removing excess coating material from a honeycomb body provides a uniform coating thickness where the honeycomb body is coated with a coating material and then subjected to a rotation around a first rotational axis wherein the distance A from the center of gravity of the honeycomb body to the rotational axis is at least 1.5 times the length of the honeycomb body. An even more uniform coating thickness is achieved when the honeycomb body is rotated around a second rotational axis that is different from the first rotational axis.

Certain modifications and improvements will occur to those skilled in the art upon a reading of the foregoing description. All such modifications and improvements of the present invention have been deleted herein for the sake of conciseness and readability but are properly within the scope of the following claims.

What is claimed is:

1. A method of removing excess coating material from a honeycomb body having flow channels comprising the steps of:

coating the honeycomb body with a coating material;

defining a longitudinal axis of the honeycomb body; and rotating the honeycomb body around a first rotational axis with a first rotational frequency to create a centrifugal acceleration in parallel to the flow channels so as to transport excess coating material in the honeycomb body to the outside.

2. The method of claim 1 wherein a distance between a center of gravity of the honeycomb body and the first rotational axis is at least 1.5 times a length of the honeycomb body.

3. The method of claim 1 wherein a distance between a center of gravity of the honeycomb body and the first rotational axis is at least 5 times a length of the honeycomb body.

4. The method of claim 1 wherein a distance between a center of gravity of the honeycomb body and the first rotational axis is at least 10 times a length of the honeycomb body.

5. The method of claim 1 further comprising the step of adding an additional acceleration to the centrifugal acceleration.

6. The method of claim 5 further comprising the step of positioning the longitudinal direction of the honeycomb body generally parallel to the direction of a total acceleration resulting from a sum of the centrifugal acceleration and the additional acceleration.

7. The method of claim 6 wherein the step of adding an additional acceleration comprises the step of changing the frequency of the first rotational frequency.

8. The method of claim 7 wherein the change in the frequency of the first rotational frequency is predetermined.

9. The method of claim 7 wherein a timing of the first rotational frequency is predetermined.

10. The method of claim 5 wherein the step of adding an additional acceleration comprises the step of rotating the honeycomb body around a second rotational axis with a second rotational frequency, wherein the first rotational axis is different from the second rotational axis.

11. The method of claim 10 wherein the first rotational frequency is faster than the second rotational frequency.

12. The method of claim 11 wherein the ratio of the first rotational frequency to the second rotational frequency is 5:1.

13. The method of claim 11 wherein the ratio of the first rotational frequency to the second rotational frequency is 20:1.

14. The method of claim 11 wherein the ratio of the first rotational frequency to the second rotational frequency is 100:1.

15. The method of claim 5 wherein a total acceleration resulting from a sum of the centrifugal acceleration and the additional acceleration is at least two times higher than an acceleration of gravity.

16. The method of claim 5 wherein a total acceleration resulting from a sum of the centrifugal acceleration and the additional acceleration is at least six times higher than an acceleration of gravity.

17. The method of claim 5 wherein a total acceleration resulting from a sum of the centrifugal acceleration and the additional acceleration is at least twenty times higher than an acceleration of gravity.

18. The method of claim 1 further comprising the step of subjecting the honeycomb body to a compressed air current before creating the centrifugal acceleration.

19. The method of claim 1 further comprising the step of subjecting the honeycomb body to a compressed air current after creating the centrifugal acceleration.

20. The method of claim 1 further comprising the step of vibrating the honeycomb body during said rotating step.

* * * * *

UNITED STATES PATENT AND TRADEMARK OFFICE

CERTIFICATE OF CORRECTION

PATENT NO. : 7,090,892 B2
APPLICATION NO. : 10/964419
DATED : August 15, 2006
INVENTOR(S) : Robert Becker et al.

It is certified that error appears in the above-identified patent and that said Letters Patent is hereby corrected as shown below:

Column 8

Claim 7, line 17, "claim 6" should read -- claim 5 --.

Signed and Sealed this

Fifth Day of June, 2007

JON W. DUDAS
*Director of the United States Patent and Trademark Office*